United States Patent [19]

Yuchi

[11] Patent Number: 4,785,283

[45] Date of Patent: Nov. 15, 1988

[54] DETECTING SYSTEM AND DETECTOR

[75] Inventor: Sadataka Yuchi, Sagamihara, Japan

[73] Assignee: Hochiki Kabushiki Kaisha, Tokyo, Japan

[21] Appl. No.: 25,503

[22] Filed: Mar. 13, 1987

[30] Foreign Application Priority Data

Mar. 18, 1986 [JP] Japan ..... 61-60095

[51] Int. Cl.[4] ..... G08B 23/00; G08B 17/10

[52] U.S. Cl. ..... 340/501; 340/511; 340/630; 340/588

[58] Field of Search ..... 340/501, 500, 506, 511, 340/510, 588, 589, 521, 632, 634, 630

[56] References Cited

U.S. PATENT DOCUMENTS

| | | | |
|---|---|---|---|
| 4,388,616 | 6/1983 | Machida | 340/501 |
| 4,390,869 | 6/1983 | Christen et al. | 340/632 |
| 4,546,344 | 10/1985 | Guscott et al. | 340/501 |
| 4,556,873 | 12/1985 | Yamada et al. | 340/511 |

*Primary Examiner*—Donnie L. Crosland
*Attorney, Agent, or Firm*—Max Fogiel

[57] ABSTRACT

A detecting system and a detector which includes an analog sensor for sensing a change in a quantity of an environmental phenomenon, processes a signal corresponding to a detection level output from said analog sensor to detect a change in the environmental phenomenon, in which the detecting sensitivity of analog sensor may be changed between a plurality of sensitivity levels according to the quantity of the phenomenon.

16 Claims, 6 Drawing Sheets

DETECTING SYSTEM AND DETECTOR

FIELD OF THE INVENTION

This invention relates to a detecting system and a detector which detects a change in an environmental phenomenon due to, for example, a fire or gas leakage, based on a detection signal from an analog sensor.

BACKGROUND OF THE INVENTION

In general, such a detecting system is so arranged that a detection signal level from the sensor increases in proportion to a rise of the value of the environmental phenomenon such as a smoke density. By this reason, the sensitivity of the sensor is fixed.

With this arrangement, if the sensitivity of the analog sensor is set so as to be optimum for the detection for a range of relatively low smoke density, the detection signal level from the analog sensor will be raised largely even if the smoke density increases only a bit. Therefore, it often occurs that the detection signal is soon saturated, exceeding a dynamic range or full span of devices at later stages such as an A/D converter to which the detection signal is supplied and that the smoke density detection over a change range to be detected can not be assured.

On the other hand, if the sensitivity of the analog sensor is set so as to be optimum for the detection for a range of relatively high smoke density, a change in the detection signal level relative to a change in the smoke density will be small. Therefore, when the smoke density is relatively small, the detection is liable to be influenced by external noises. Moreover, accurate detection can not be assured with an A/D converter for general use having an ordinary resolution.

To solve these problems, it has been proposed as a compromise to set the sensitivity of the sensor so as to be optimum for a range of intermediate smoke density, a bit sacrificing the detection accuracy at the low or high smoke density. An alternative solution comprises a plurality of analog sensors of different sensitivities which are provided in each of detectors, or an A/D converter of high resolution. Such a solution, however, increases a cost of the entire system.

The present invention has been made to overcome the problems as described above, and it is an object of the present invention to provide a detecting system and a detector, in which the sensitivity of an analog sensor is not fixed with reference to a change in an environmental phenomenon (for example, a density of smoke or gas), but it can be changed according to a change in the environmental phenomenon. More specifically, it is an object of the present invention to provide a detecting system and a detector, in which the sensitivity of the analog sensor is set so that the detection signal from the analog sensor may vary within a range not exceeding the dynamic range of devices at later stages such as an A/D converter, whereby the detection accuracy can be improved, even when a single sensor is used, over a wide range of changes in the environmental phenomenon, by effectively using the dynamic range of the devices at the later stages.

The present invention to attain the object features a detecting system a detecting system including an analog sensor provided in a detector for sensing a change in a quantity of an environmental phenomenon and a receiver adapted to receive and process a signal corresponding to a detection level output from said analog sensor for detecting the change in the environmental phenomenon, the improvement comprising a sensitivity setting means which changes the detection sensitivity of said analog sensor between a plurality of sensitivity levels according to the quantity of said phenomenon.

The present invention further features a detector which includes an analog sensor for sensing a change in a quantity of an environmental phenomenon and processes a signal corresponding to a detection level output from said analog sensor to detect a change in the environmental phenomenon, the improvement comprising a sensitivity setting means which changes the detecting sensitivity of said analog sensor between a plurality of sensitivity levels according to the quantity of the phenomenon.

DESCRIPTION OF PREFERRED EMBODIMENT

Figure 1:
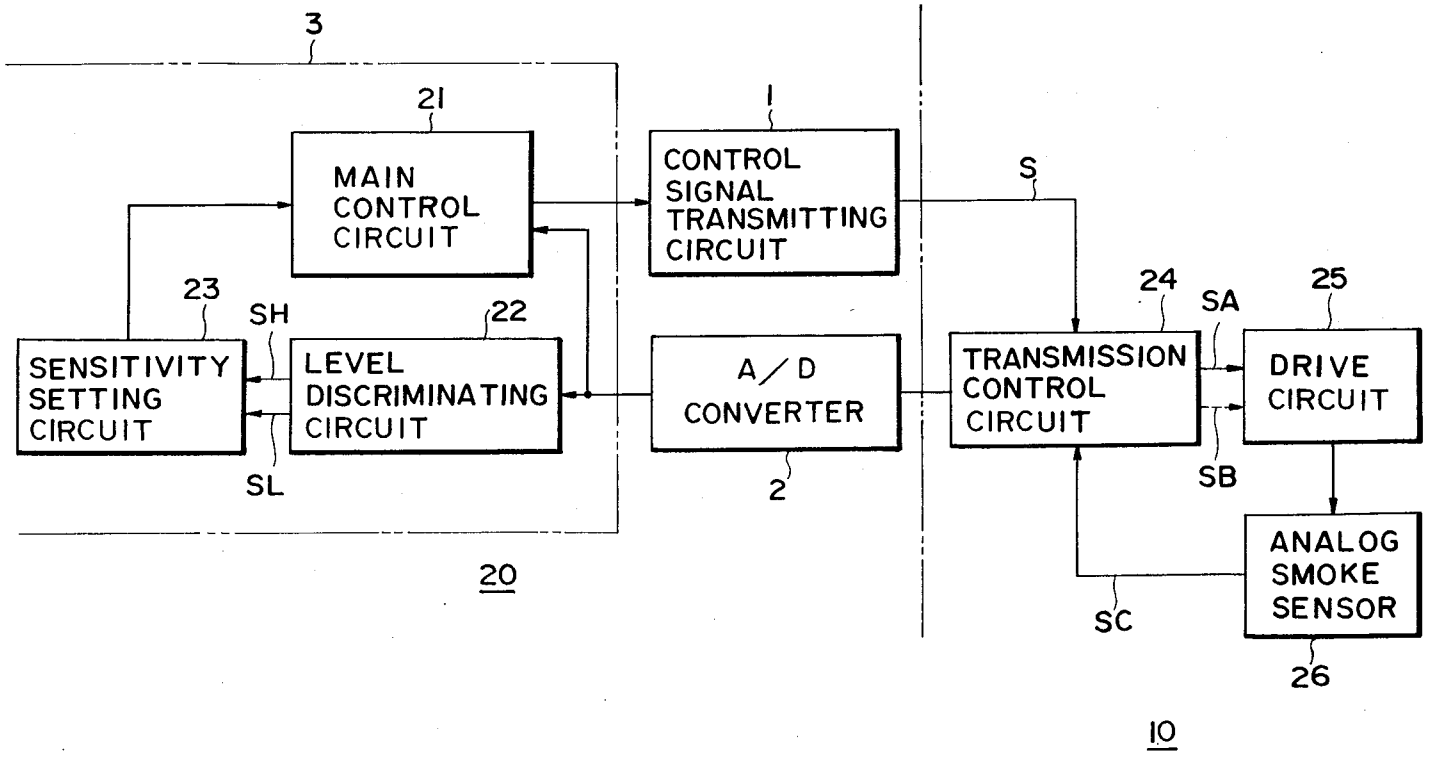
FIG.1 is a block diagram showing one form of smoke detecting system embodying the present invention.

Preferred embodiments of the present invention will now be described, referring to the drawings.

In FIG. 1, 10 designates a smoke detector and 20 designates a receiver or a signal station, which are connected by transmission lines. A plurality of detectors 10 are connected to one receiver 20, but FIG. 1 shows only one of detectors 10 for clarification and simplicity and only a part of the receiver 20 related to detector 10 as illustrated. Signal transmission is attained by way of polling between the receiver 20 and each of the detectors.

The receiver 20 includes a control signal transmitting circuit 1 for transmitting an actuation control signal to the side of the detector 10, and A/D converter 2 for converting a detection signal (analog signal) from the detector 10 into a digital signal and a microcomputer 3 which mandates the control signal transmitting circuit 1 to carry out the signal transmission control by the polling and analyzes the signal input through the A/D converter 2 to determine if there is a fire or not.

On the other hand, the detector 10 comprises a transmission control circuit 24, a drive means 25 and an analog smoke sensor 26. The detector 10 as illustrated and other detectors not illustrated are allocated with their own addresses, respectively, and operate sequentially in response to the polling from the receiver 20.

The microcomputer 3 of the receiver 20 includes a main control circuit 21, a level discriminating circuit 22 and a sensitivity setting circuit 23.

The main control circuit 21 controls the actuation of the respective detector 10 by way of polling and analyzes a detection signal SC transmitted from the detector 10 to determine the changing conditions of an environmental phenomenon such as a fire.

The level discriminating circuit 22 compares a signal level of the detection signal SC from the detector 10 with a threshold level and outputs a discrimination signal SH or SL when the detection signal level is out of a range within the threshold level. The discrimination signal SH is output when the detection signal level exceeds the specific threshold level, while the discrimination signal SL is output when the detection signal level is lowered to below the specific threshold level.

The sensitivity setting circuit 23 stores a plurality of sensitivity setting data for setting the sensitivity of the sensor 26 provided in the sensor 10. To enable the sensitivity of the sensor 26 to be changed according to the density of smoke, a plurality of smoke density ranges, from low to high, are provided and the sensitivity setting data as described above are determined so that a specific sensitivity may be set for the respective smoke density range.

The sensitivity setting circuit 23 outputs a sensitivity setting data other than the present one to the main control circuit 21 to change the sensitivity of the sensor 26 when the discrimination signal SH or SL is output from the level discriminating circuit 22.

The sensitivity setting circuit 23 may, of course, use another means such as logical discriminating circuit in place of the up/down counter.

Figure 3:
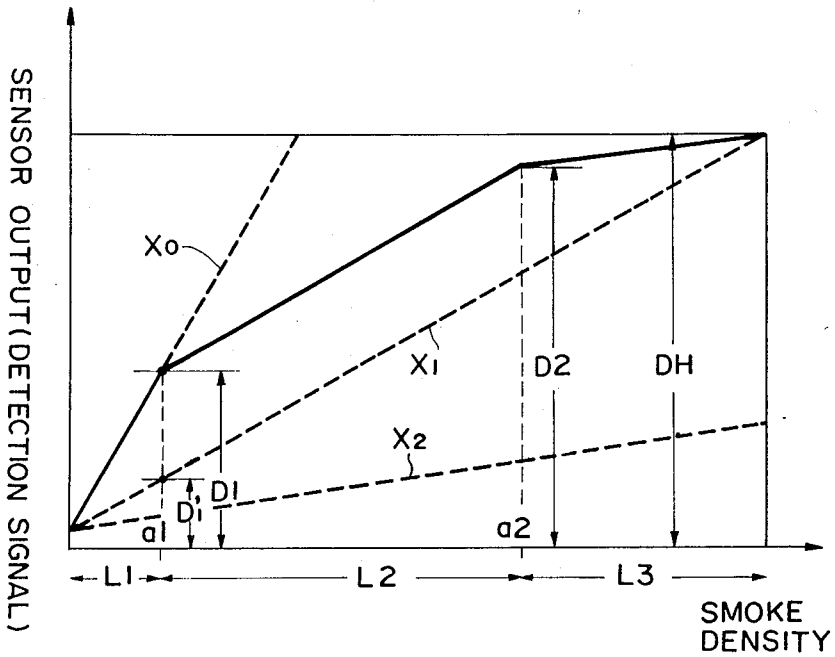
FIG. 3 shows relationships between a detection signal level from an analog sensor and a smoke density, which are varied corresponding to three, different sensitivity settings, respectively.

The sensitivity setting data stored in the sensitivity setting circuit 23 are provided for the smoke density ranges L1, L2 and L3 as shown in FIG. 3, respectively. Each of the sensitivity is so selected that it can fully utilize a full span DH of a dynamic range within a range where the output level of the detection signal SC does not exceed the full span of the dynamic range. For example, in a scattered light type detector using a photosensor, the sensitivity is so set that it may be increased within the dynamic range or full span when the smoke density is low, because an amount of light received is reduced accordingly, while it may be lowered as the smoke density increases, because the amount of light received increases accordingly.

The main control circuit 21 transmits a control signal S containing an actuation control signal SA for actuating the sensor 26 and the sensitivity setting data SB to the particular detector 10 by the polling.

Figure 2:
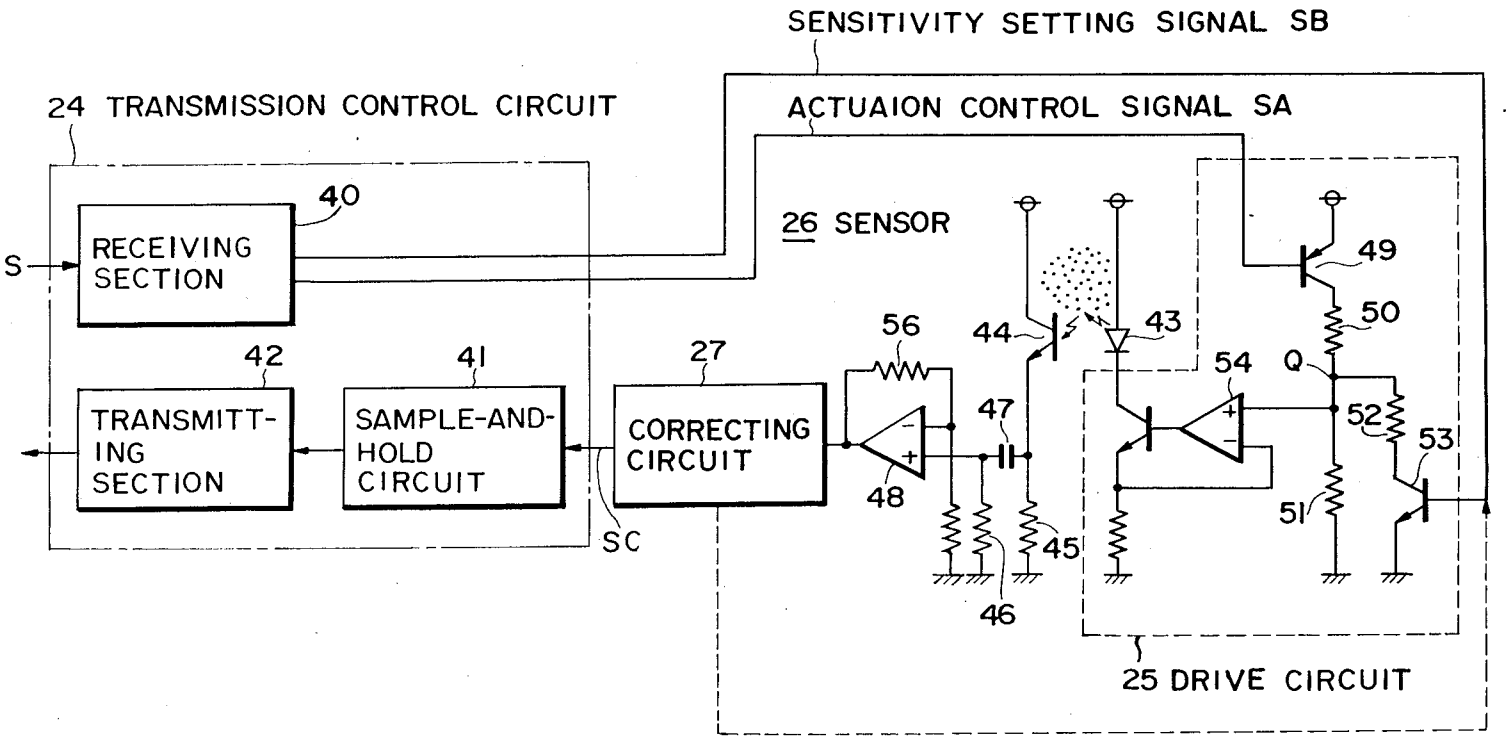
FIG.2 is a circuit diagram of details of a detector in the smoke detecting system as shown in FIG. 1.

FIG. 2 shows a embodiment of a circuit of the detector 10 in detai. The transmission control circuit 24 of the detector 10 includes a receiving section 40 adapted to receive the control signal S from the receiver 20 and output the predetermined actuation control signal SA and the sensitivity setting data SB, an S/H circuit (sample-and-hold circuit) 41 for tentatively holding the detection signal SC from the sensor 26 and a transmitting section 42 for transmitting the detection signal held by the S/H circuit 41 to the receiver 20.

The sensor 26 comprises a light emitting diode 43, a phototransistor 44, a preamplifier 48 connected through a high-pass filter formed of resistors 45 and 46 connected to a terminal of the phototransistor 44 and a capacitor 47 and a correcting circuit 27 for output characteristics.

The drive means 25 is formed of a PNP transistor 49 connected in series between a power supply terminal and a grounding terminal, resistors 50 and 51, a resistor 52 and NPN transistor 53 which connect a contact Q of the resistor 51 to the grounding terminal, and a buffer amplifier 54 and PNP transistor 55 for supplying a predetermined current to the light emitting diode 43 according to the potential at the contact. The actuation control signal SA is supplied to the transistor 49 and the sensitivity setting data SB is supplied to the transistor 53.

In response to the calling from the receiver 20, the receiving section 40 determines calling and a sensitivity setting signal, then output a signal changed from a high level to a low level and it is supplied to a base of the transistor 49 as an actuation control signal SA to turn on the transistor 49. When the transistor 49 is conducting, if a current determined for the sensitivity setting signal SB is supplied to the transistor 53, the potential at the contact Q is set by the impedance of the transistor 53 and the resistances of the resistors 52 and 51. As a result of this, a current corresponding to the sensitivity setting signal SB is supplied to the light emitting diode 43. In an initial state, a sensitivity setting signal SB for low smoke density (smoke density within a range L1 smaller than a1 on the abscissa of FIG. 3) is supplied, so that a large current is supplied to the light emitting diode 43 to increase an emitted light amount. This will provide a maximum sensitivity to the sensor 26 and the relationship between the smoke density and the sensor output will be a characteristic line X0 in FIG. 3. As a result of this, even a small change in the smoke density can be detected large in the detection signal SC. This is especially effective to make an early fire prediction. When the smoke density is increased, a corresponding sensitivity setting signal SB of low sensitivity is supplied to the transistor 53 and the current flowing through the light emitting diode 43 is varied to lower the sensitivity of the sensor 26 accordingly. Under these low sensitivity conditions, even if the smoke density is increased, the output level of the sensor 26 does not exceed the full span of the dynamic range of the devices at the later stages so rapidly. Therefore, even when a change in the phenomenon breaks out, the detecting operation can be continued after the first detection of the change to take some action, for example, guidance for evacuation.

In the present embodiment, the current value of the sensitivity setting signal SB is changed to vary the impedance of the transistor for changing the sensitivity. But, the sensitivity changing means employable in the present invention is not limited to that and it may be any means which can change the potential at the contact Q.

Figure 4:
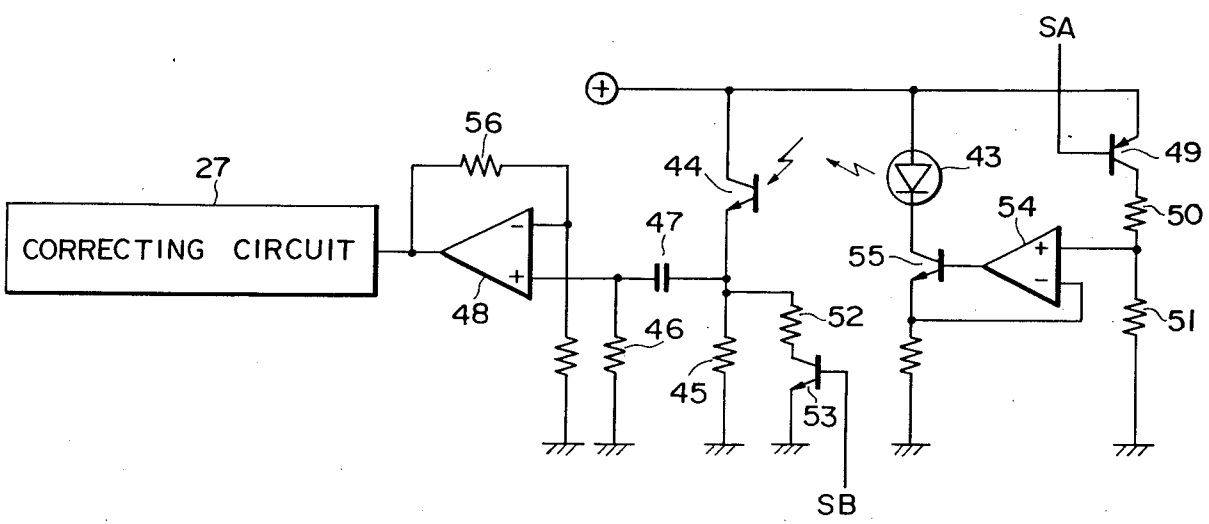

Alternatively, the resistor 52 and the transistor 53 may be provided in parallel with the resistor 45 as illustrated in FIG. 4, to relatively change a voltage of the detection signal supplied to the devices at the later stages for changing the sensitivity.

Figure 5:
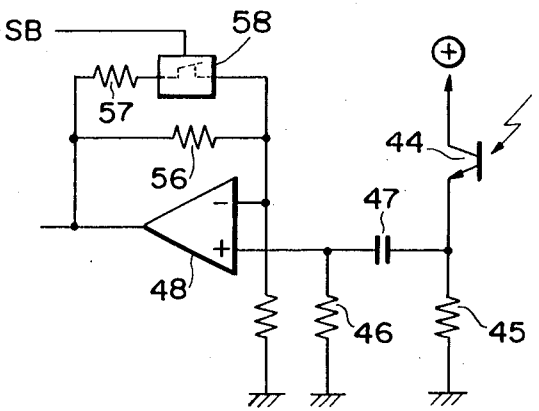
FIG. 4 and FIG. 5 show circuit arrangements for setting the sensitivity of the analog sensor, respectively.

Further alternaively, the value of a feedback resistor setting a multiple-factor of the preamplifier 48 may be changed. More specifically, a resistor 57 may be connected in parallel with a feedback resistor 56 as illustrated in FIG. 5 and an analog switch 58 may be closed or opened by the sensitivity setting data SB to change the mu-factor of the preamplifier 48. The analog switch 58 may suitably be a bilateral switch formed of MOSFET.

With the arrangement as described above, when the smoke density is varied and the sensitivity of the sensor 26 is changed, the relationship between the output signal level and the smoke density will change along the straight line X0, X1 or X2 of FIG. 3 unless no correction treatment is carried out. Under the conditions where the smoke density is lower than a1, the relationship between the smoke density and the output signal value is represented by the line X0. Within a range in which the smoke density is higher than a1 but lower than a2, the relationship is represented by the line X1, while within a range in which the smoke density is higher than a2, the relationship is designated by the line X2. With this arrangement, when the sensitivity of the sensor 26 is changed at the output signal level D1, the output signal level D1 is lowered to D1'. This means there exist two output values for the same smoke density. The receiver 20 therefore can not determine which is the real value. Therefore, the microcomputer 3 must carry out an operation processing, while defining the sensitivity of the sensor 26 and the output value to determine the smoke density.

Figure 6:
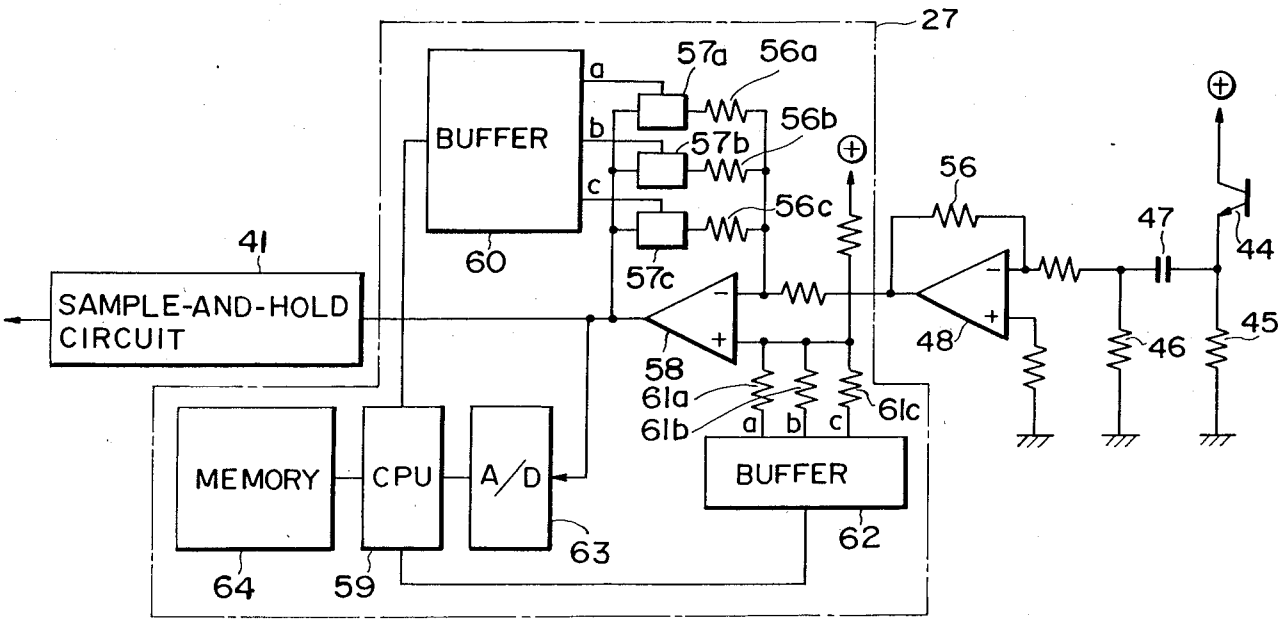
FIG. 6 is a block diagram showing a correcting circuit in FIG. 2.

This problem may be solved by providing additional processing steps in a program of the microcomputer 3, and it may also be solved by employing the correcting circuit 27. The correcting circuit 27 will be described in detail. The correcting circuit 27 is provided to solve this problem. The correcting circuit 27 may, for example, be formed as illustrated in FIG. 6. More particularly, the feedback resistance and the threshold voltage of an operational amplifier 58 connected to the output side of the preamplifier 48 may be varied. Feedback resistors 56*a*, 56*b* and 56*c* are each connected, in parallel, with the operational amplifier 58 and are ON-OFF controlled by corresponding analog switches 57*a*, 57*b* and 57*c*, respectively, to vary a synthesized resistance. A CPU 59 controls a buffer 60 to ON-OFF drive the analog switches 57*a*, 57*b* and 57*c*. Resistors 61*a*, 61*b* and 61*c* for varying the threshold voltage are each connected, in parallel, to the operational amplifier 58. CPU 59 controls a buffer 62 to vary a synthetic resistance of these resistors. An A/D converter 63 is connected to the output side of the operational amplifier 58 so that the output valve from the operational amplifier 58 may be stored in a memory 64.

With this respect, when the output from the operational amplifier reaches predetermined levels, more specifically, levels at which the sensitivity of the sensor 26 should be changed, i.e., D1 or D2 in FIG. 3, the then output value is stored in the memory 64. CPU 59 controls the buffers 60 and 62 according to this stored output value to vary the feedback resistance, the multiple-factor of the operational amplifier 58 and the threshold voltage, thereby to change the output characteristics of the operational amplifier 58. If the change amount is selected suitably, then the output from the correcting circuit 27 to the S/H circuit 41 assumes a solid bent line in FIG. 3 as a result of the sensitivity change of the sensor 26. This enables the sensor output value to correspond one-to-one to the smoke density and allows the receiver 20 to make a determination easier.

The operation of the entire system of the present invention will now be described.

An actuation control signal SA is supplied by the polling from the receiver 20 to render the transistor 49 conductive. At the same time, a sensitivity setting data SB is input to the transistor 53 to supply a current corresponding to the sensitivity setting signal SB to the light emitting diode 43. Scattered light emitted from the light emitting diode 43 is received by the phototransistor 44, passed through the high-pass filter and amplified by the preamplifier 48 to transmit the output to the output characteristic correcting circuit 27. This output signal is output from the output characteristic correcting circuit 27 as a detection signal SC.

In the case where no fire breaks out, a sensitivity setting signal SB for a low smoke density (range L1) is supplied, so that a large current is supplied to the light emitting diode 43 to increase an amount of light emitted. This gives the sensor 26 the maximum sensitivity so that it can detect a small change in the smoke density as a large detection signal SC.

If the smoke density becomes higher due to a fire breaking-out etc. and the amount of the scattered light is increased to raise the level of the detection signal SC output from the preamplifier 48 to the level D1, then the level discriminating circuit 22 as shown in FIG. 1 discriminates it and the sensitivity setting circuit 23 outputs a sensitivity setting signal SB for setting a sensitivity which the sensor 26 is to have thereafter. The sensitivity of the sensor 26 is changed in response to this sensitivity setting signal SB.

Thereafter, if the smoke density is further increased and the level of the detection signal SC reaches the level D2, then the level discriminating circuit 22 detects it and the sensitivity setting circuit 23 outputs a sensitivity setting signal SB for setting another sensitivity for the sensor 26. The sensor 26 changes its sensitivity depending upon an impedance change of the transistor 53 corresponding to the sensitivity setting signal SB.

The above description only refers to the operation when the smoke density is increased, but it will be apparent that the changing operation would be revered when the smoke density decreases.

Although the sensitivity of the sensor 26 is changed by the sensitivity setting signal SB from the main control circuit 21 provided in the receiver 20 in the embodiment as described above, the control signal for the buffers 60 and 62 generated from CPU 59 of the correcting circuit 27 may alternatively be used. More particularly, the correcting circuit 27 may be connected to the drive circuit 25 and the output from CPU of the correcting circuit 27 to the buffers 60 and 62 may be supplied to the drive circuit 25 to provide the sensitivity setting data similarly. In other words, the sensitivity change can be effected in the detector itself. This is shown by a broken line from the correcting circuit 27 to the transistor 53 in FIG. 2. As apparent from the above description, the detection signal output from the sensor 26 will be as shown by the bent line in FIG. 3 which is more disirable as compared with the characteristics (broken lines X0, X1 and X2) of the conventional detection signals from the sensor. With this respect, if a wide range of smoke density is to be detected according to the conventional detector, the entire sensitivity is lowered as shown by the broken line X2, while if the entire sensitivity is raised, then a detectable range of smoke density is restricted as shown by a broken line X1. In contrast, according to the present invention, the sensitivity is changed so that it is raised within a smoke density range in which the detection of the smoke density is crucial to discriminate, for example, a fire, and the sensitivity is lowered when the fire can be apparently be discriminated. Therefore, proper and accurate fire determination can be assured over a wide range of smoke density.

Moreover, when the detection signal is converted to a digital signal, an effect equivalent to the conversion with an A/D converter of high resolution can be obtained. This, in effect, enables practical cut down of the manufacturing cost of the system.

Although the illustrated embodiment is applied to a detecting system of a scattered-light type using a photosensor, this invention may alternatively be applied to a detecting system of a transmitted-light type using a photosensor. In the latter case, the transmitted light amount decreases and the level of the output signal from the phototransistor is lowered as the smoke density is raised. Thus, sensitivity setting data are also needed as in the sensitivity setting in the scattered-light type detecting system for lowering the sensitivity of the sensor as the smoke density increases.

Figure 7:
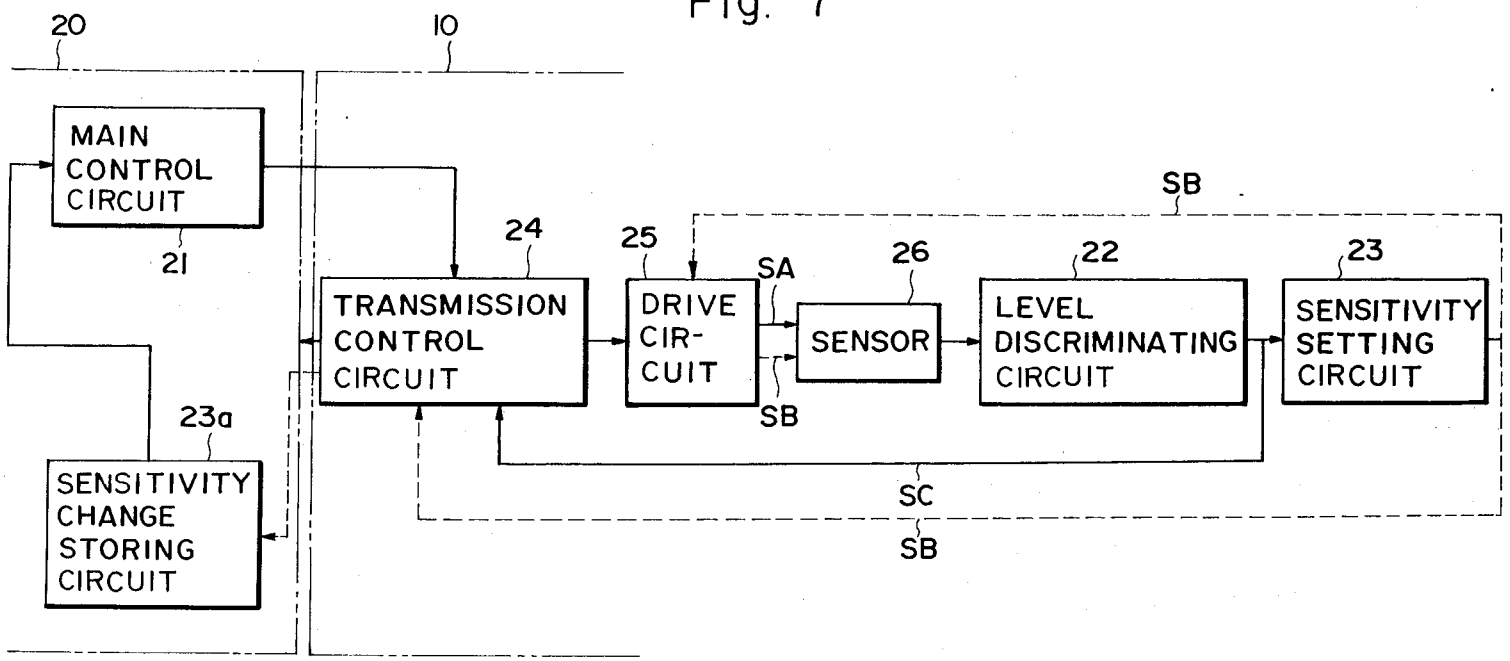
FIG. 7 is a block diagram showing another form of a smoke detecting system embodying the present invention.

FIG. 7 is a block diagram showing another embodiment of the present invention. In the present embodiment, the level discriminating circuit 22 and the sensitivity setting circuit 23 are included in the detector 10 and a sensitivity change storing circuit 23*a* for storing a changing information for the sensitivity setting circuit 23 is provided in the receiver in place of the correcting circuit 27 of the detector 10.

The sensitivity change storing circuit 23*a* sequentially stores the sensitivity setting signals SB output for the smoke density ranges, respectively. The sensitivity change storing means 23*a* stores the count value obtained by counting up in response to the discrimination signal SH by the up/down counter of the sensitivity setting circuit 23 or counting down in response to the discrimination signal SL. Based on the stored count data, the receiver 20 can recognizes the smoke density range for which the sensitivity of the sensor 26 is being set.

With this arrangement, the sensitivity setting signal SB from the sensitivity setting circuit 23 is directly supplied to the drive circuit 25, and only an information indicative that the sensitivity has been changed is transmitted from the transmission control circuit 24 to the sensitivity change storing circuit 23*a*. With this arrangement, a real smoke density can be obtained by the reverse computation from the stored count data and the sensitivity setting signal data. Thus, the presence or state of a fire can be accurately determined as in the foregoing embodiment.

In this embodiment, the information amount of the transmitting signal can be reduced, so that the polling for controlling the detector 10 from the receiver 20 can be implemented more easily and the number of the detectors connectable in the system can be increased.

Although the foregoing two embodiments are applied to the smoke detecting system employing a photosensor, they may also applicable to the system employing another type of analog sensor. Similarly, although the transmission between the receiver and the detectors are carried out in a current mode in the embodiments, it may alternatively be effected, for example, in the form of digital code.

Although the sensitivity is changed between three levels in the foregoing two embodiments, the number of levels between which the sensitivity may be changed will be able to set to desired number of levels in accordance with a phenomenon to be detected. The number should be two or more and the number will be determined by setting a number of threshold levels at which the sensitivity will be changed.

Therefore, the scope of the present invention is not limited to the preferred embodiments as illustrated and described above and as set forth in the following claims, and various changes and modifications connoted by the claims are within the scoped of the invention.

I claim:

1. A detecting system for detecting a change in an environmental phenomenon comprising:

an analog sensor in a detector for sensing said change in a quantity of said environmental phenomenon and having an output signal;

said analog sensor having a detection range classified into a plurality of areas correlating with the quantity of said phenomenon;

a receiver for receiving and processing a signal corresponding to a detection level of an output from said analog sensor;

sensitivity setting means changing automatically a detection sensitivity of said analog sensor when said detection level changes and belongs into another area;

said sensitivity setting means comprising:

level discriminating means for emitting a discrimination signal indicating which one of areas the output signal from said analog sensor is included in;

setting signal emitting means for emitting a sensitivity characteristic level setting signal according to said discrimination signal;

correcting means which can hold the output signal level being emitted from said analog sensor so as not to change when the sensitivity characteristics of said analog sensor is changed and so as to prevent the corresponding relationship between the output signal level from the analog sensor and the quantity of the phenomenon from being discontinuous; and drive means for driving a sensing element in said analog sensor to vary according to said setting signal;

whereby, said sensitivity of said analog sensor is moved up to a higher level than a current level so as to accomplish a more detailed and precise detection in an area wherein the detection is required, sensitivity of said analog sensor being lowered in the other area wherein a more rough detection than the current level is required.

2. A detecting system as defined in claim 1, wherein said level discriminating means, said setting signal emitting means and said correcting means are located in the receiver, said drive means being located in said analog sensor.

3. A detecting system as defined in claim 2, including an amplifier for amplifying a sensing output signal from said sensing element of the analog sensor, said correcting means varying a threshold level of the amplifier.

4. A detecting system as defined in claim 3, wherein said correcting means stores and holds said sensitivity level setting signal in a readable form, said analog sensor changing the characteristics of a device driving said sensing element by the sensitivity level setting signal to vary the detecting sensitivity level of the analog sensor.

5. A detecting system as defined in claim 1, wherein said level discriminating means and said setting signal emitting means are located in said receiver, said correcting means and said drive means being located in said analog sensor.

6. A detecting system as defined in claim 5, including an amplifier for amplifying a sensing output signal from said sensing element of said analog sensor, said correcting means varying a threshold level of the amplifier.

7. A detecting system as defined in claim 6, wherein said correcting means stores and holds said sensitivity level setting signal in a readable form, said analog sensor changing the characteristics of a device driving said sensing element by the sensitivity level setting signal to vary the detecting sensitivity level of the analog sensor.

8. A detecting system as defined in claim 1, wherein said level discriminating means, said setting signal emitting means, said correcting means and said drive means are located in said analog sensor.

9. A detecting system as defined in claim 8, including an amplifier for amplifying a sensing output signal from said sensing element of the analog sensor, said correcting means varying a threshold level of the amplifier.

10. A detecting system as defined in claim 9, wherein said correcting means stores and holds said sensitivity level setting signal in a readable form, said analog sensor changing the characteristics of a device driving said sensing element by the sensitivity level setting signal to vary the detecting sensitivity level of the analog sensor.

11. A detecting system as defined in claim 1, wherein said level discriminating means, said setting signal emitting means and said drive means are located in said analog sensor, said correcting means being located in said receiver.

12. A detecting system as defined in claim 11, including an amplifier for amplifying a sensing output signal from said sensing element of the analog sensor, said correcting means varying a threshold level of the amplifier.

13. A detecting system as defined in claim 12, wherein said correcting means stores and holds said sensitivity level setting signal in a readable form, said analog sensor changing the characteristics of a device driving said sensing element by the sensitivity level setting signal to vary the detecting sensitivity level of the analog sensor.

14. A detector for detecting a change in an environmental phenomenon comprising:

an analog sensor for sensing a change in a quantity of said environmental phenomenon and having an output signal;

said analog sensor having a detection range classified into a plurality of areas correlating with the quantity of said phenomenon;

sensitivity setting means changing a detection sensitivity of said analog sensor according to said correlation between each of said areas and the quantity of said phenomenon;

said sensitivity setting means comprising:

level discriminating means for emitting a discrimination signal indicating which one of areas the output signal from said analog sensor is included in;

setting signal emitting means for emitting a sensitivity characteristic level setting signal according to said discrimination signal;

correcting means which can hold the output signal level being emitted from said sensor so as not to change when the sensitivity characteristics of said analog sensor is changed and so as to prevent the corresponding relationship between the output signal level from said analog sensor and the quantity of the phenomenon from being discontinuous; and drive means for driving a sensing element of said analog sensor to vary according to said setting signal;

whereby said sensitivity of said analog sensor is moved up to a higher level than a current level so as to accomplish a more detailed and precise detection in an area wherein such the detection is required, sensitivity of said analog sensor being lowered in the other area wherein a more rough detection than the current level is required.

15. A detector as defined in claim 14, including an amplifier for amplifying a sensing emitting signal from said sensing element of said analog sensor, said correcting means varying a threshold level of the amplifier.

16. A detector as defined in claim 15, wherein said correcting means stores and holds said sensitivity level setting signal in a readable form, said analog sensor changing characteristics of a device driving said sensing element by the sensitivity level setting signal to vary the detecting sensitivity level of said analog sensor.

* * * * *